United States Patent [19]

Labbe

[11] Patent Number: 4,852,589

[45] Date of Patent: Aug. 1, 1989

[54] CIGARETTE MAKING MACHINE

[75] Inventor: Francis A. M. Labbe, Neuilly-sur-Seine, France

[73] Assignee: Molins PLC, London, England

[21] Appl. No.: 168,467

[22] Filed: Mar. 15, 1988

Related U.S. Application Data

[63] Continuation of Ser. No. 885,142, Jul. 14, 1986, Pat. No. 4,742,834.

[30] Foreign Application Priority Data

Jul. 12, 1985 [GB] United Kingdom ..... 8517647

[51] Int. Cl.[4] ..... A24D 5/14

[52] U.S. Cl. ..... 131/84.3; 131/84.1; 131/108; 131/110

[58] Field of Search ..... 131/84.1, 84.3, 108, 131/110, 84.1, 84.3, 108, 110, 84.4

[56] References Cited

U.S. PATENT DOCUMENTS

| | | | |
|---|---|---|---|
| 3,851,652 | 12/1974 | Labbe | 131/84.3 |
| 3,987,804 | 10/1976 | Molins et al. | 131/84.3 |
| 4,122,859 | 10/1978 | Preston | 131/84.3 |
| 4,175,570 | 11/1979 | Heitman | 131/108 |
| 4,256,125 | 3/1981 | Labbe | 131/84.3 |
| 4,397,320 | 8/1983 | Labbe | 131/84.1 |
| 4,580,579 | 4/1986 | Wahle | 131/84.1 |
| 4,646,758 | 3/1987 | Seragnoli | 131/84.3 |
| 4,651,754 | 3/1987 | Lorenzen et al. | 131/84.3 |

*Primary Examiner*—V. Millin

*Attorney, Agent, or Firm*—Antonelli, Terry & Wands

[57] ABSTRACT

A cigarette making machine includes a channel (10; 100; 204) through which tobacco is pneumatically conveyed to form a cigarette filler stream (15; 209) on a conveyor (12; 130; 220) at the outlet of the channel, a first louvre (20; 110; 214) through which some of the air entering the channel through its inlet end is drawn from the channel while tobacco continues towards the conveyor, and a second louvre (22; 120; 216), closer than the first louvre to the outlet end of the channel, through which an additional amount of the air entering the channel is drawn while the tobacco continues towards the conveyor. The channel (202) may be arranged to extend around a cylinder with an inclined axis (208) so that upward movement of the tobacco is converted into approximately horizontal movement with a substantial component in the direction of movement of the conveyor (200) on which the tobacco collects to form a cigarette filler stream (209).

3 Claims, 4 Drawing Sheets

CIGARETTE MAKING MACHINE

This is a continuation of application Ser. No. 885,142, filed July 14, 1986 U.S. Pat. No. 4,742,8340.

This invention is concerned with cigarette making machines of the type including a channel through which tobacco is conveyed pneumatically to form a cigarette filler stream on a conveyor at the outlet of the channel. An example of such a machine is described in British patent specification No. 916141. The machine described in that specification includes a louvre through which some of the air entering the channel is extracted while tobacco continues towards the conveyor; the use of such louvres has been common in Molins cigarette making machines for many years.

According to one aspect of the present invention, a cigarette making machine includes a channel through which tobacco is pneumatically conveyed to form a cigarette filler stream on a conveyor at the outlet of the channel, a first louvre through which some of the air entering the channel through its inlet end is drawn from the channel while tobacco continues towards the conveyor, and a second louvre, closer than the first louvre to the outlet end of the channel, through which an additional amount of the air entering the channel is drawn while tobacco continues towards the conveyor.

Effectively, the second louvre according to its invention corresponds to the louvre used hitherto, the difference being in the provision of the first louvre. Owing to the presence of the first louvre, the air velocity beyond the first louvre is reduced compared with the velocity of air entering the channel, and this results in a reduction in the tobacco velocity on impact with the conveyor. The reduced impact velocity is beneficial in that it reduces tobacco breakage. The arrangement can be such that, compared with previous machines, the air velocity entering the channel is substantially unchanged, e.g. at approximately 60 feet/sec (approximately 18.3 metres/sec), so as to achieve the desired separation of tobacco particles and possible also deflection in accordance with the second aspect of this invention, while allowing the tobacco to arrive at the conveyor with a much lower velocity (well below 30 feet/-sec).

In this context the term "louvre" refers generally to an air outlet comprising one or more openings so arranged that air is drawn through the opening or openings without any significant amount of tobacco, which instead remains in the channel and continues its movement towards the conveyor. Each louvre preferably comprises a number of openings, the parts between the openings being preferably inclined as in a conventional louvre (as shown in specification No. 916141).

As has been common practice in Molins machines, the flow of air through the channel is preferably induced by suction; in the present invention suction is preferably applied to both louvres. This invention will be described in such terms, but it should be understood that it is conceivable, as an alternative, to use above-atmospheric pressure to induce the air flows occurring in the present invention, and the following description and claims should be constructed accordingly.

In the present content the term "carpet" refers to a stream of mainly separated particles of tobacco having a width (transverse to the direction of movement of the tobacco) considerably greater than the thickness.

One application of this aspect of this invention is concerned with arranging that the tobacco arrives at the conveyor with a significant component of movement in the direction of movement of the conveyor. The conveyor may, for example, be a band which is inclined to the horizontal by up to 15 degrees so as to convey the cigarette filler stream downwards onto the web of cigarette paper in which the stream is subsequently enclosed. Accordingly, if the tobacco is to have a component of movement in the direction of movement of the conveyor, its path must be inclined to the vertical by more than 15 degrees. It may be desirable, for example, to arrange for the path of the tobacco as it approaches the conveyor to be inclined to the vertical by at least 40 degrees. However, it is usually convenient for the hopper of the cigarette making machine to project the tobacco vertically upwards into the channel. As described in our British patent specification No. 2096876, the tobacco may be given an additional horizontal component of motion on or immediately before entering the channel by deflecting, by means of curved vanes, air flowing upwards into the channel. The air velocity required for this purpose needs to be relatively high, and this can be achieved by means of the first aspect of this invention while allowing for a reduction in the air velocity near the outlet (upper) end of the channel to reduce the impact velocity of tobacco on the conveyor.

According to another aspect of this invention, a cigarette making machine comprises means for forming a carpet of tobacco and for conveying the carpet pneumatically through a channel towards a conveyor to form a cigarette filler stream on the conveyor, characterised in that the channel extends around a cylindrical surface having an axis inclined to the center line of a first part of the channel conveying the carpet towards the cylindrical surface, and that a second part of the channel which is arranged to convey the carpet after it has passed around the cylindrical surface has its center line inclined to that of the first mentioned part of the channel and to the axis of the cylindrical surface.

The motion of the tobacco passing around the cylindrical surface may be compared with the motion of a web passing around a turning bar. If the axis of the cylindrical surface is set at 45 degrees to the horizontal, for example, then the path of the tobacco may initially be vertically upwards and will then extend horizontally after passing around the cylindrical surface. This example in fact represents a preferred use of this aspect of this invention to enable tobacco to be delivered to the conveyor with a substantial component of movement in the direction of movement of the conveyor.

In a preferred machine according to this aspect of the invention, the upwardly extending inlet end portion of the channel is divided into two parts which extend around two different cylindrical surfaces offset from one another but inclined to the horizontal by the same angle, whereby the outlet end portions of the two outlet channels lie side-by-side. Thus the tobacco passing through the two channels approaches the conveyor from opposite sides of a central vertical plane through the conveyor and, in the preferred arrangement, combines to form what may be regarded as a braid of tobacco on the conveyor.

Other aspects of this invention will be understood from the appended claims.

Examples of machines according to this invention are shown in the accompanying drawings. In these drawings.

Figure 1:
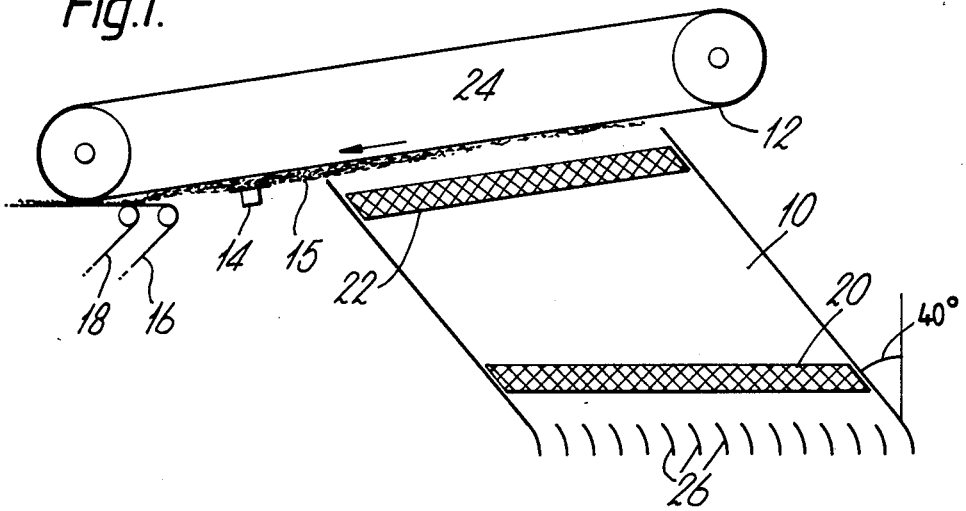
FIG. 1 is a diagrammatic front view of a machine embodying some aspects of this invention.

FIG. 1 shows a cigarette making machine including a channel 10 through which a carpet of tobacco is conveyed pneumatically upwards towards a conveyor 12 to form a cigarette filler stream 15 on the conveyor. The filler stream is trimmed by a trimmer 14 and is then deposited on a wrapper web 16 carried by a garniture tape 18. The rear wall of the channel includes a first louvre 20 near the inlet end of the channel, and a second louvre 22 near the outlet end of the channel. As usual with this type of machine, the conveyor 12 is porous and has suction applied to it from a suction chamber 24 so as to grip the tobacco arriving on the conveyor.

Tobacco enters the lower end of the channel 10 in an upward direction and is deflected, so as to have a component of motion in the direction of movement of the conveyor 12, by air streams flowing into the lower end of the channel between deflector vanes 26, the arrangement being generally as described with reference to FIGS. 1 and 2 in our British patent specification No. 2096876. It should be noted that the channel is inclined to the vertical, as shown in FIG. 1, by an angle which is approximately 40 degrees.

In order to deflect the incoming tobacco, the initial air velocity needs to be relatively high. This is achieved by virtue of the fact that air is drawn in through the inlet of the channel as a result of suction applied to both of the louvres 20 and 22. However, above the louvre 20 the air velocity is significantly lower and the tobacco velocity is correspondingly reduced, thus avoiding a high-velocity impact of tobacco on the conveyor 12.

By way of example, suction may be applied to both louvres 20 and 22 from the same source, and the open areas and loss coefficients of the two louvres may be similar. The term "loss coefficient" refers to a measure of the pressure drop through the respective louvres.

Figure 2:
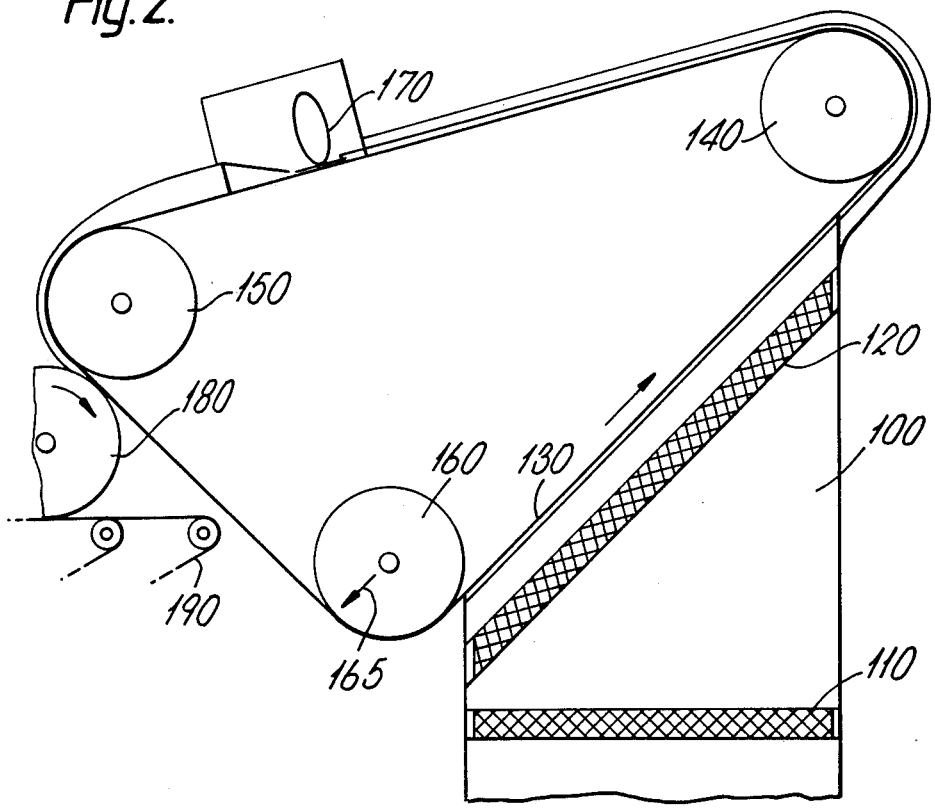
FIG. 2 is a diagrammatic front view of a second machine embodying the first aspect of this invention.

FIG. 2 shows a different machine. In this case, tobacco is conveyed pneumatically through a vertical channel 100 with the aid of suction louvres 110 and 120 towards a conveyor 130 of which the portion adjacent to outlet of the channel 100 is inclined to the channel by 45 degrees so that the tobacco arriving on the conveyor again has a significant component of motion in the direction of movement of the conveyor. The conveyor in this case passes around three pulleys 140, 150 and 160 of which the last is adjustable in the direction of the arrow 165 to tension the conveyor. A cigarette filler stream formed on the conveyor is trimmed by a trimmer 170 and is then transferred from the conveyor by a transfer wheel 180 to a wrapper web 190. There is no need in this case to deflect the tobacco as it enters the channel.

Figure 3:
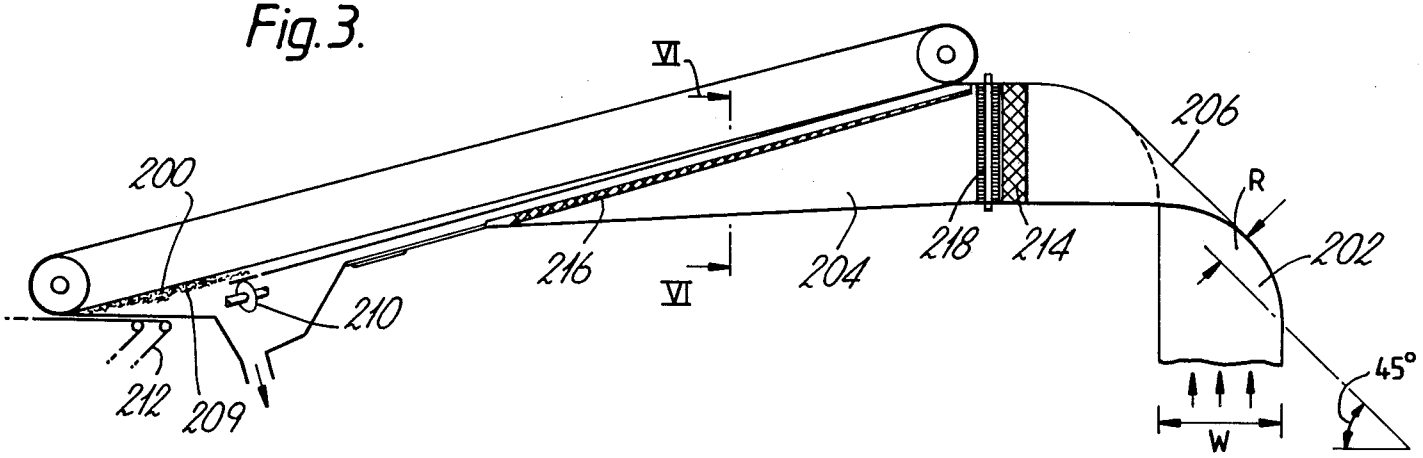
FIG. 3 is a diagrammatic front view of a machine embodying a further aspect of this invention.

FIG. 3 shows a machine embodying a different aspect of this invention. Tobacco is conveyed pneumatically onto a conveyor 200 through a channel comprising a vertical first portion 202, an approximately horizontal second portion 204 and a joining portion 206 which is notionally curved around a cylinder having an axis 208 inclined to the vertical by 45 degrees; the radius of the cylinder is R. With this arrangement, the tobacco arrives at the conveyor with a major component of its movement in the direction of movement of the conveyor, the conveyor 200 being in this example inclined to the horizontal by 15 degrees. As before, the cigarette filler stream 209 formed on the conveyor is trimmed by a trimmer 210 and is then deposited on a wrapper web 212.

As in the previous examples, there is a first louvre 214 lying transverse to the direction of movement of the tobacco through the channel, and a second louvre 216 which is parallel to the conveyor 200. To compensate for the variable flow resistance for tobacco at various positions across the width of the channel (owing to the variable path length), the louvre 216 increases progressively in width towards the lower extremity of the channel, i.e. as the path length increases. Similar considerations apply to FIG. 2, but to a lesser extent.

Depending upon the relationships of the suction pressures at various points in the system, especially above the conveyor 200 and in the suction louvres, and upon other factors affecting the air flows, the rate at which air is drawn through the conveyor 200 at any given position along the conveyor may need to be greater than the air flow rate at a corresponding position across the width of the channel. In this case, there should be provision to admit air into the channel 204 at a position close to the tobacco stream on the conveyor, preferably from both sides. The width of the air inlets would vary along the conveyor to admit the appropriate amount of air at each point. In principle, it is possible for some positions along the conveyor to require air inlets and no louvre, while at other positions the air flow characteristics require both a louvre and an inlet, or just a louvre. However, it is preferable to provide a louvre and an inlet along substantially the entire length of the conveyor (ie, at the outlet from the channel 204).

FIG. 3 shows in addition a rotary brush 218 rotating about a vertical axis to control the velocity of the tobacco entering the horizontal portion 204 of the channel. However, this brush may be omitted. The first louvre 214 may, in principle, be omitted provided there is an adequate air flow through the channel 204 to convey the tobacco through the channel.

As a modificatin of the machine shown in FIG. 3, tobacco may be delivered directly into the horizontal channel 204 by a tobacco feed apparatus as described with reference to FIGS. 1 to 5 in our British Patent Specification No. 1396273.

In view of the small angle of inclination between the channel 204 and the conveyor 200 (approximately 15 degrees), the channel has to be relatively narrow (i.e., dimension W is relatively small) to avoid a need for an excessively long conveyor. As an alternative, the initial width of the channel may be doubled, without requiring a longer conveyor, if the channel is split to form two portions passing around different notional cylinders. This is explained below with reference to FIGS. 4 and 5.

Figure 4:
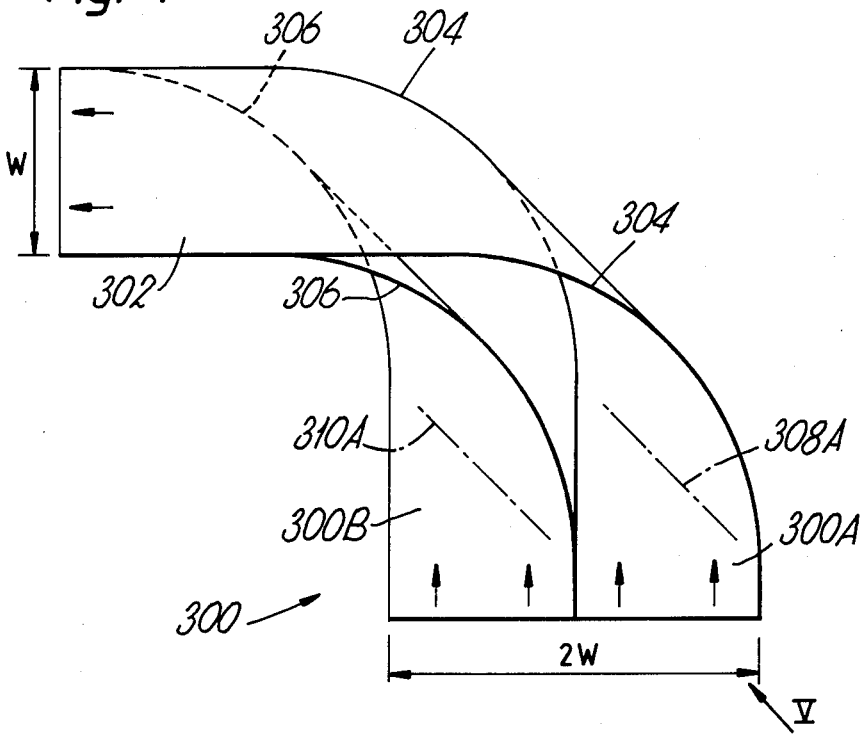
FIG. 4 illustrates a modified form of channel for the machine shown in FIG. 3.

As shown in FIG. 4, a channel comprising a vertical first portion 300 of width 2W is split longitudinally into two portions 300A and 300B respectively, each of width W, leading to horizontal second portions 302 and 303 (of width W) via curved portions 304 and 306 respectively. This may be best understood with reference to FIG. 5, which shows in complete outline the notional cylinders 308 and 310 around which the two curved portions 304 and 306 respectively pass; these cylinders have axes 308A and 310A which, as seen in FIG. 4, are inclined to the vertical by 45 degrees. It should be noted that the cylinder 310 has a slightly smaller diameter than the cylinder 208 so that the horizontal portion 302 is spaced from the portion 303. With this arrangement, a tobacco carpet of width 2W can be conveyed pneumatically onto the conveyor 200 shown in FIG. 3. FIG. 6 shows a preferred way of achieving that.

FIG. 6 is a section on the line VI—VI in FIG. 3. It should be understood that it applies to a modified form of FIG. 3 in which the channel is split as described above with reference to FIGS. 4 and 5.

Figure 5:
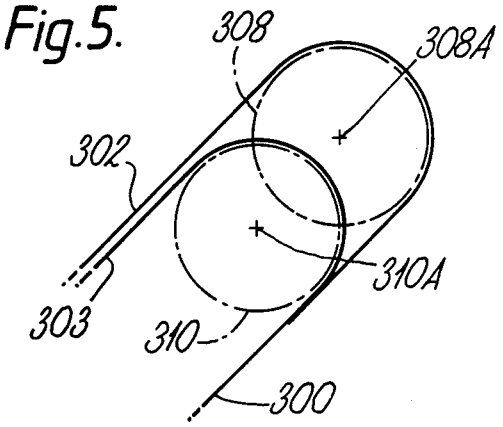
FIG. 5 is a diagrammatic view in the direction of the arrow V in FIG. 4.
Figure 6:
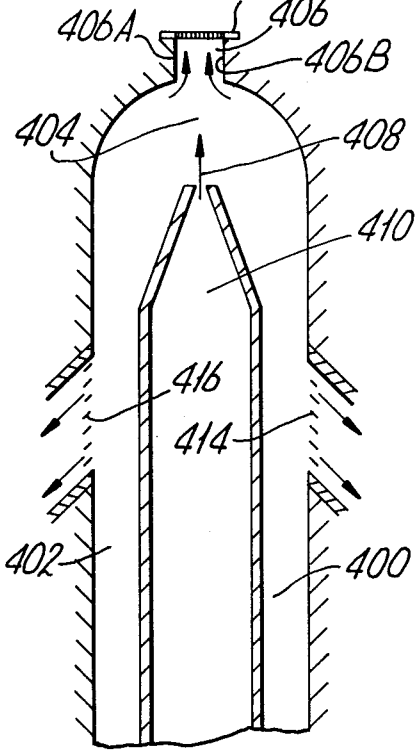
FIG. 6 is a vertical section through the split channels provided by the modified arrangement shown in FIGS. 4 and 5, taken effectively at line VI—VI in FIG. 3.

In FIG. 6, the two side-by-side channel portions formed by the split channel shown in FIGS. 4 and 5 are identified by the reference numerals 400 and 402 respectively. Tobacco carpets flowing through these channels merge in the region 404, producing a form of braid which is blown into a trough 406 by air jets (or by continuous curtain of high-velocity air) blown upwards, in the direction of the arrow 408, from a space 410 which may be at atmospheric pressure. Above the trough 406 lies the conveyor 412; as usual, suction is applied through the conveyor from a space (not shown) above the conveyor to hold tobacco on the conveyor.

The air admitted or blown in from the space 410 may also serve the same function as the air inlets described above with reference to FIG. 3.

Each channel portion 400 and 402 has a separate louvre 414 and 416 respectively, corresponding to the louvre 216 shown in FIG. 3. As mentioned with reference to FIG. 3 the width of each louvre may increase progressively as the path length for tobacco increases.

The depth of the trough 406 defined by fixed side walls 406A and 406B increases progressively to accommodate the increasing amount of tobacco at various positions along the conveyor.

For the avoidance of doubt, it should be understood with reference to FIG. 6 that the motion of tobacco is nearly at right angles to the plane of the figure.

Figure 7:
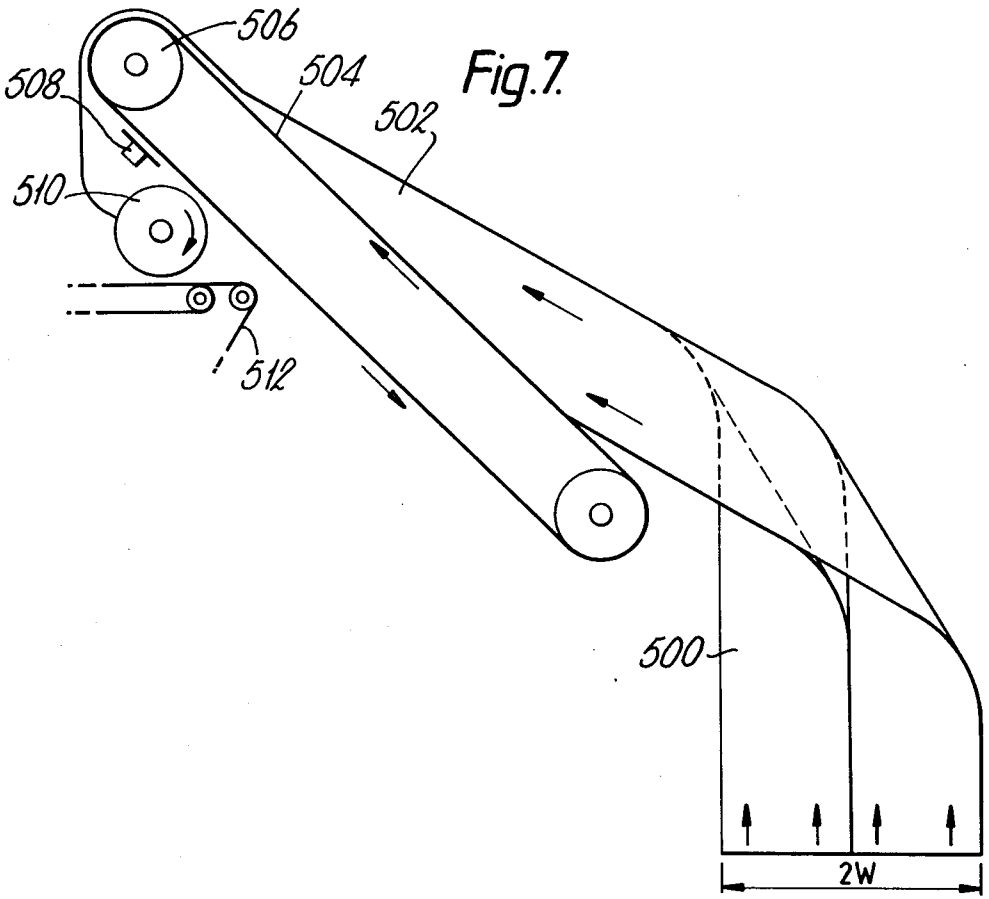
FIG. 7 is a diagrammatic front view of another different machine.

FIG. 7 shows a different machine in which a channel with a vertical first portion 500 of width 2W leads into two side-by-side portions 502 of width W lying at 60 degrees to the vertical and extending towards a conveyor 504 lying at 45 degrees to the vertical. It should be understood that the bending of the channel portions in this instance results from an arrangement in which each channel passes around a notional cylinder having its axis inclined to the vertical by 30 degrees. The channels may each include one or more louvres as described with reference to FIG. 3.

In FIG. 7 the cigarette filler stream is held on the conveyor 504 by suction while it passes around a pulley 506, is then trimmed by a trimmer 508 and is transferred to a wrapper web 512 by a suction wheel 510.

In the examples of FIGS. 3 to 7, the arrival of the tobacco at the conveyor with a major component of motion in the direction of movement of the conveyor means that, apart from reducing damage to the tobacco, there is a reduced tendency (compared with prior machines) for the tobacco to be flattened on impact with the conveyor, or with tobacco already on the conveyor, with consequent aligning of the strands of tobacco in the direction of movement of the conveyor. Such aligning tends to reduce the firmness of the finished cigarette rod, so that more tobacco has to be used to provide a given firmness. Random orientation of the tobacco strands, on the other hand, which is promoted by the substantial "forward component" provided by the present invention in all its aspects enhances cigarette firmness and also ends retention.

Random orientation of tobacco strands is also promoted by the deepening trough described with reference to FIG. 6 (and also useful in the simpler arrangement of FIG. 3). Tobacco strands arriving at the conveyor retain their random orientations instead of being sucked through the relatively narrow trough with a consequent tendency towards flattening of the strands along the conveyor.

I claim:

1. A cigarette making machine including means for conveying a layer of tobacco to be showered pneumatically to form a cigarette filler stream, shower means for showering two portions of the tobacco stream along separate paths towards a downstream end of the shower means at which two separate laterally-spaced sub-filler streams of tobacco collect, and means for combining the two sub-filler streams to form a cigarette filler stream of which the respective sub-filler streams form contiguous horizontally spaced components, said combining means including means for causing movement of the sub-filler streams from laterally spaced positions to positions in which the sub-filler streams contact one another.

2. A cigarette making machine according to claim 1 including a conveyor for conveying the completed cigarette filler stream and arranged to move along fixed side walls defining a trough having a progressively increasing depth in the region in which the sub-filler streams are formed, so that the depth at each position along the conveyor is just sufficiently substantially to accommodate the quantity of each sub-filler stream formed at that position.

3. A cigarette making machine including means for conveying a layer of tobacco to be showered pneumatically to form a cigarette filler stream, shower means for showering two portions of the tobacco stream along separate paths towards a downstream end of the shower means at which two separate laterally-spaced sub-filler streams of tobacco collect, and means for combining the two sub-filler streams to form a cigarette filler stream of which the respective sub-filler streams form contiguous horizontally spaced components, said combining means including means for causing movement of the sub-filler streams from laterally spaced positions to positions in which the sub-filler streams contact one another, in which the shower means comprises a channel divided longitudinally into two parts which extend around two different part-cylindrical surfaces offset from one another but having substantially parallel axes, whereby the portions of the channel downstream of the part-cylindrical surfaces lie side-by-side so as to convey portions of the tobacco shower to form the respective sub-filler streams in the vicinity of the conveyor.

* * * * *